US008869729B2

(12) United States Patent
Montousse

(10) Patent No.: US 8,869,729 B2
(45) Date of Patent: Oct. 28, 2014

(54) UNDERWATER PERSONAL MOBILITY DEVICE

(76) Inventor: Julien Montousse, Los Angeles, CA (US)

( * ) Notice: Subject to any disclaimer, the term of this patent is extended or adjusted under 35 U.S.C. 154(b) by 49 days.

(21) Appl. No.: 13/533,541

(22) Filed: Jun. 26, 2012

(65) Prior Publication Data

US 2013/0008366 A1 Jan. 10, 2013

Related U.S. Application Data

(60) Provisional application No. 61/505,987, filed on Jul. 8, 2011.

(51) Int. Cl.

| | |
|---|---|
| ***B63C 11/44*** | (2006.01) |
| ***A63B 35/12*** | (2006.01) |
| ***B63C 11/46*** | (2006.01) |

(52) U.S. Cl.

CPC ..... *B63C 11/44* (2013.01); *A63B 35/12* (2013.01); *A63B 2208/03* (2013.01); *A63B 2225/60* (2013.01); *B63C 11/46* (2013.01)

USPC ..... 114/313; 114/315

(58) Field of Classification Search

USPC ..... 114/242, 312, 313, 315

See application file for complete search history.

(56) References Cited

U.S. PATENT DOCUMENTS

| | | | | |
|---|---|---|---|---|
| 3,204,596 | A | 9/1965 | Fallon | |
| 5,433,164 | A | 7/1995 | Sneath | |
| 5,988,096 | A | 11/1999 | Benesch et al. | |
| 6,443,087 | B1 | 9/2002 | Stecker, Sr. | |
| 6,575,114 | B2 | 6/2003 | Sandler et al. | |
| 6,606,960 | B1 | 8/2003 | Leibolt et al. | |
| 6,941,883 | B2 | 9/2005 | Nguyen | |
| 6,990,919 | B1 * | 1/2006 | Calinawan | 114/315 |
| 7,004,099 | B2 * | 2/2006 | Iijima et al. | 114/315 |
| 7,353,767 | B2 | 4/2008 | Taelman | |
| 2009/0000617 | A1 | 1/2009 | Rosenberger | |

FOREIGN PATENT DOCUMENTS

| | | | |
|---|---|---|---|
| FR | 2914196 | A1 | 10/2008 |
| WO | WO 01/76935 | A1 | 10/2001 |

OTHER PUBLICATIONS

International Search Report; PCT/US2012/044725; Mailing Date: Nov. 20, 2012; 9 pages.

* cited by examiner

*Primary Examiner* — Lars A Olson

(74) *Attorney, Agent, or Firm* — Knobbe Martens Olson & Bear LLP

(57) ABSTRACT

An underwater personal mobility device is provided. The underwater personal mobility device can include a superstructure rotatably connected to a main body comprised of an observation chamber, a transport handle and at least one wheel. The superstructure may further comprise an air conduit and snorkel to provide breathable air to a user. The device may have at least two configurations, including a folded configuration, to enable ease of transport and storage of the device.

23 Claims, 12 Drawing Sheets

UNDERWATER PERSONAL MOBILITY DEVICE

CROSS-REFERENCE TO RELATED APPLICATIONS

This application claims the benefit of U.S. Provisional Application No. 61/505,987, entitled "UNDERWATER PERSONAL MOBILITY DEVICE," filed Jul. 8, 2011, the entirety of which is incorporated herein by reference.

FIELD OF THE INVENTION

The invention relates generally to submersible personal mobility devices.

DESCRIPTION OF THE RELATED ART

Protective coverings for persons during underwater activities are generally well known. Such previously known protective coverings may be made of water resistant, semi-rigid materials and have viewing facilities. Other known submersible devices comprise a sealed chamber which may house one or more persons. In such devices, a user enters the chamber via a hatch and has a supply of air onboard the submersible device.

SUMMARY OF THE INVENTION

One aspect of at least one embodiment of the invention is the recognition that it would be desirable to have a protective covering for underwater activities that would not require that a user be equipped with full diving equipment in order to be able to breathe underwater. Likewise, it would be desirable that such a covering not require specialized training, such as diving certifications.

Another aspect of at least one embodiment of the present invention is the recognition that it would be desirable not to have the user enter a sealed chamber via a hatch since use of such devices is generally limited by the amount of breathable air carried onboard the submersible device.

Yet another inventive aspect of at least one embodiment of the present invention is the recognition that a personal submersible device that allows a user to operate the unit without requiring the user to wear full diving equipment or necessitating a tether to the surface would have many benefits. These benefits would include increased flexibility of use, as such a device could be used by a greater number of people, including tourists or scientists, without requiring extensive training or equipment. The personal submersible device could also be easier to manipulate and transport, particularly if the device were able to fold for transportation and storage.

In addition to user-related advantages, another inventive aspect of at least one embodiment of the invention is the recognition that it would be desirable to provide a submersible personal mobility device which provides an ecological advantage through the use of renewable energy sources. These sources may be used to provide power to various components of the unit and may comprise solar panels installed on the device to provide solar-generated electrical power to be used, for example, by an electrical air pump or electric motor.

In some embodiments, including the illustrated embodiment, an underwater personal mobility device is disclosed. The underwater personal mobility device desirably comprises a superstructure comprising a snorkel, a propulsion mechanism and a main body wherein the superstructure is rotatable with respect to the main body such that the device may fold for ease of use.

In some embodiments, including the illustrated embodiment, a method of underwater exploration is disclosed. The method is desirably achieved through providing a submersible personal mobility device comprising a superstructure further comprising a snorkel, wherein the superstructure is foldable to a substantially horizontal orientation; submerging the underwater personal mobility device; unfolding said superstructure of said device to achieve a substantially vertical orientation; and breathing by a user of air which is supplied through said snorkel.

All of these embodiments are intended to be within the scope of the inventions herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects, and advantages of the present invention will now be described in connection with preferred embodiments of the present invention, in reference to the accompanying drawings. The illustrated embodiments, however, are merely examples and are not intended to limit the invention.

DETAILED DESCRIPTION OF THE PREFERRED EMBODIMENT

The following detailed description is directed to certain specific embodiments of the invention. However, the invention may be embodied in a multitude of different ways as defined and covered by the claims.

One embodiment of a personal submersible device capable of transporting a human being under water, depicted in FIGS. 1-11, comprises a main body 106 which is supported, either directly or indirectly, by a chassis 108. In the illustrated embodiment, a superstructure 113 is rotatably connected to the main body via the chassis 108. The main body 106, chassis 108 and superstructure 113 will be discussed in detail below.

Figure 1:
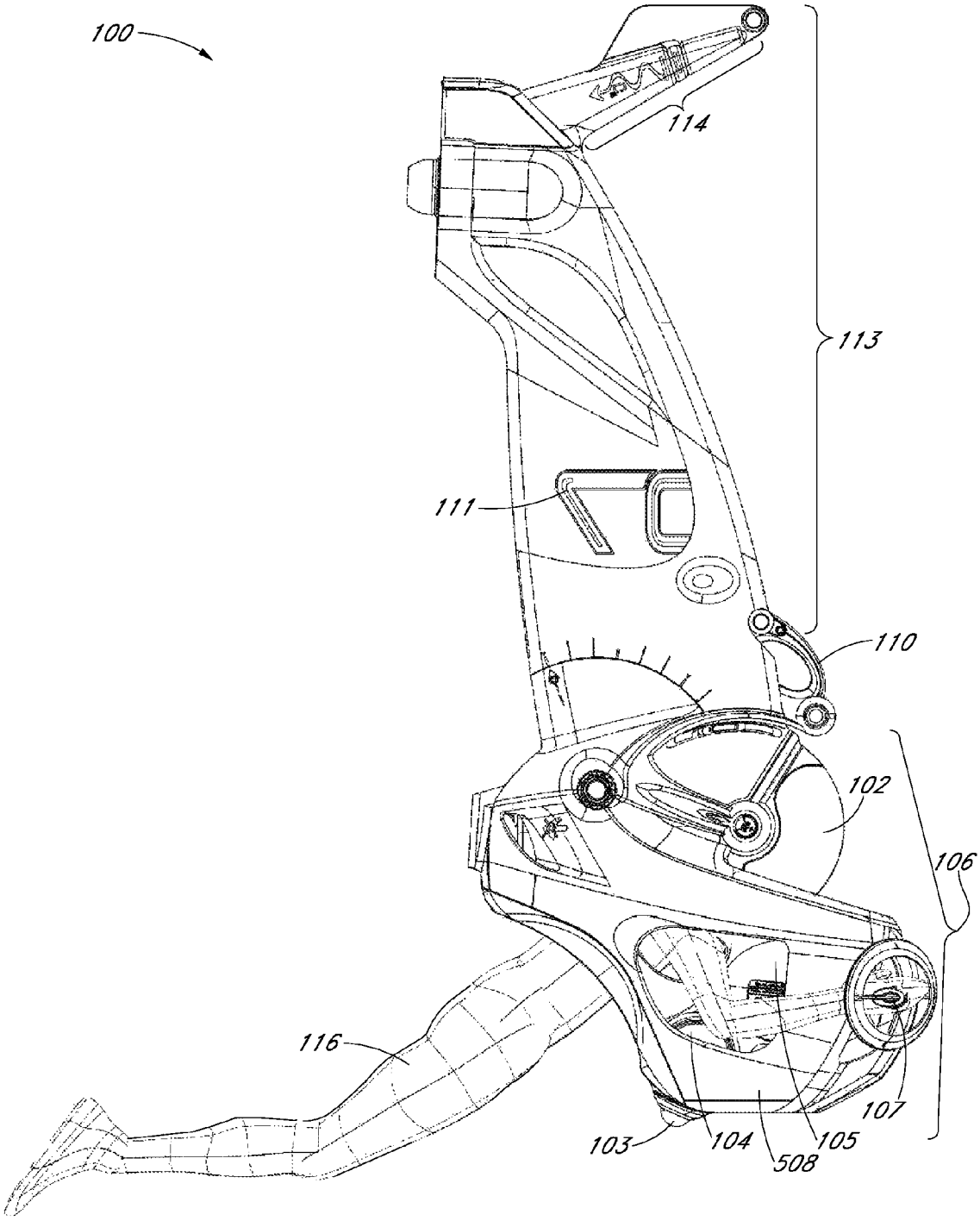
FIG. 1 is a right side view of an underwater personal mobility device according to a preferred embodiment of the invention and a user thereof.
Figure 2:
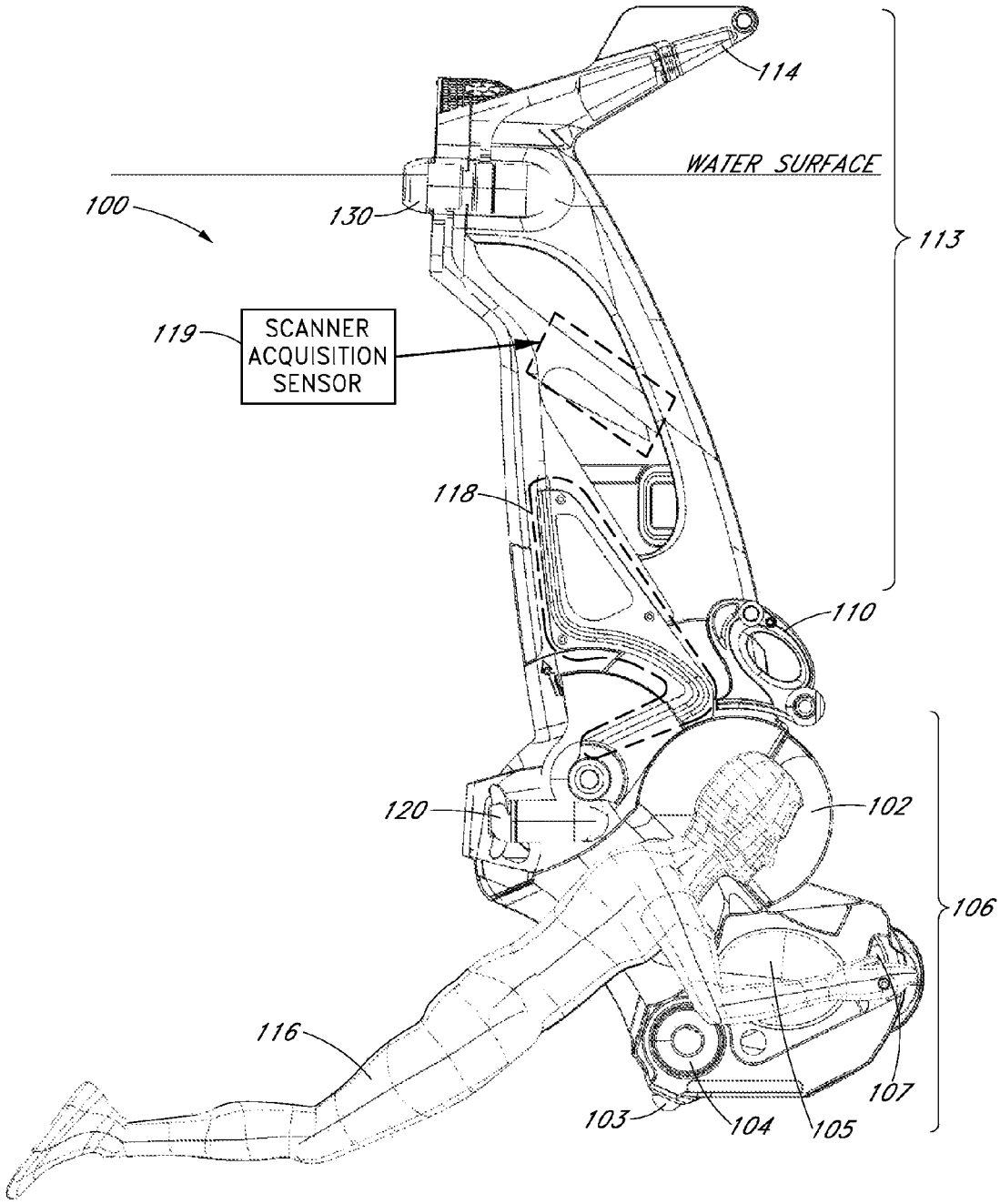
FIG. 2 is a partial cross-sectional right side view of an underwater personal mobility device and a user thereof.

To facilitate understanding of the invention, the illustrated embodiment is described in the context of an orientation system based on the user 116 facing forward as shown, for example, in FIGS. 1 and 2. Thus, the right side of the device corresponds to the user's right side, the left side of the device corresponds to the user's left side, and the front of the device corresponds to the front of the user's face when the user is facing directly forward with the chin extended horizontally. (Note in FIG. 2, the user is facing downward approximately 45 degrees from directly forward, which provides a comfortable viewing angle for the user while operating the submersible device.)

Figure 3:
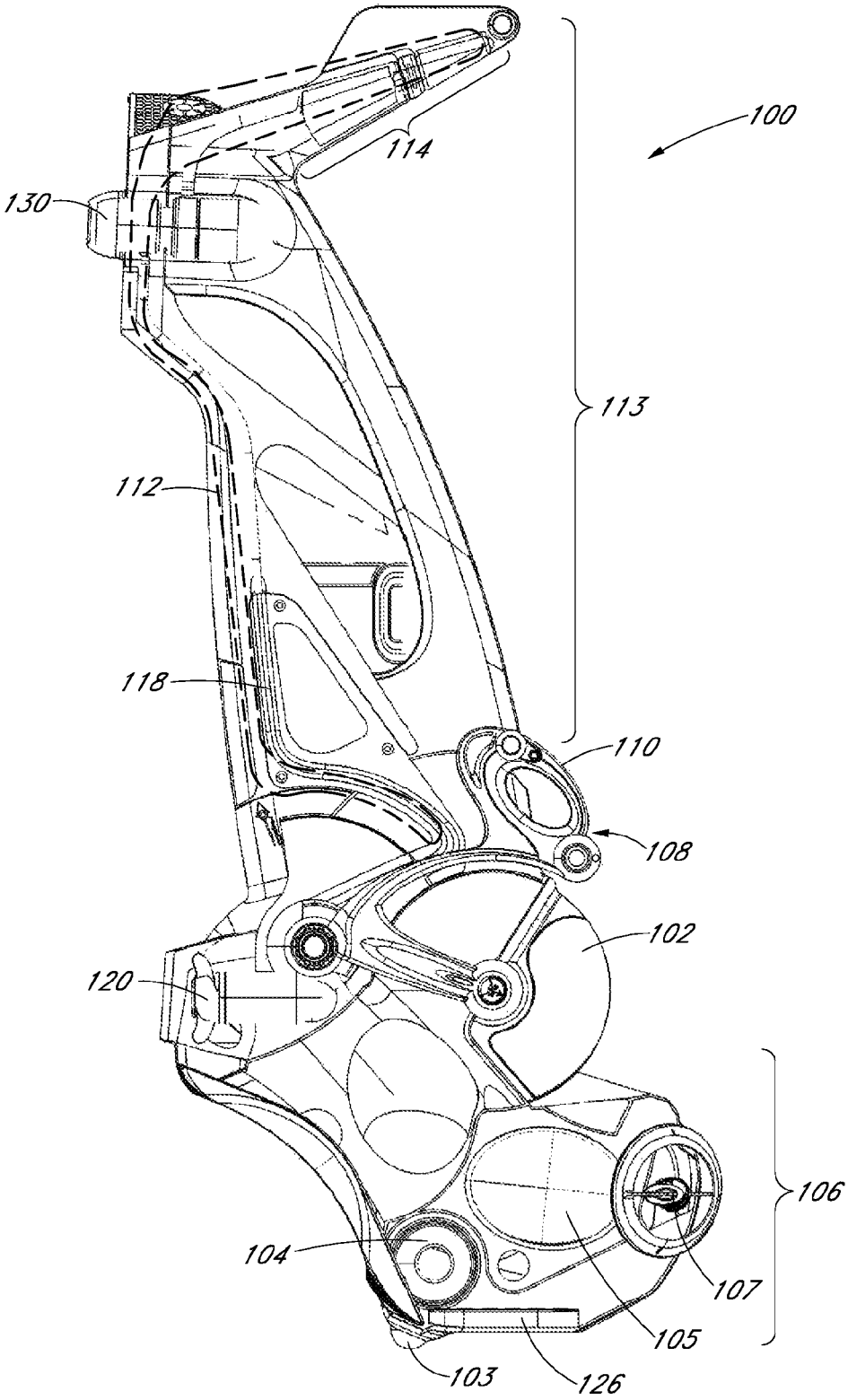
FIG. 3 is a second right side view of an underwater personal mobility device shown without a user interacting with the device.
Figure 4:
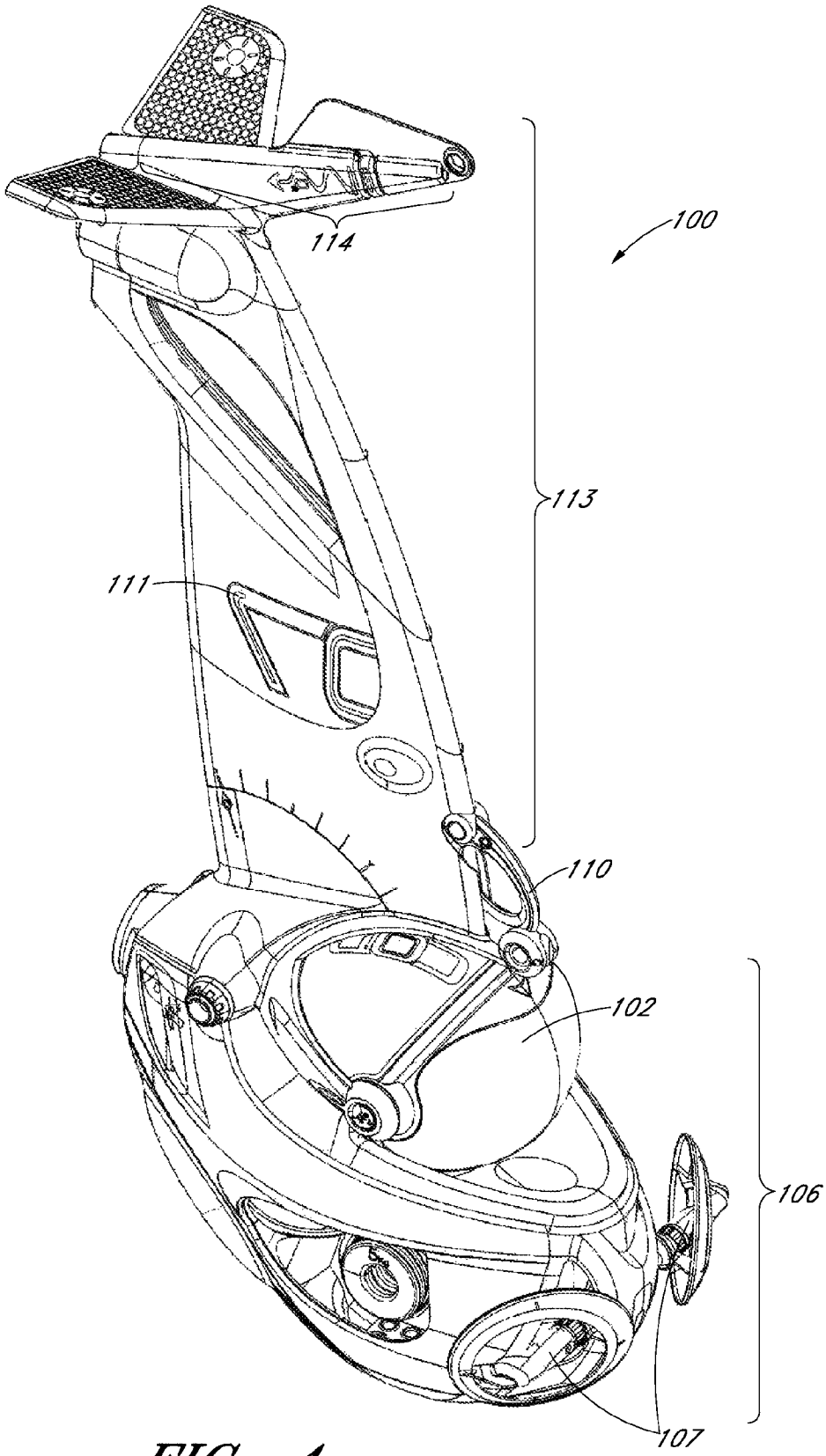
FIG. 4 is a perspective right front view of an underwater personal mobility device.

FIGS. 1-4 depict a preferred embodiment having certain features, aspects, and advantages of the present invention. FIGS. 1 and 2 depict a right side view of a preferred embodiment of the present invention shown with a user interacting with the device. FIGS. 3 and 4 depict the same embodiment as that shown in FIGS. 1 and 2 but without a user interacting with the device. Personal underwater mobility device 100 may include more, fewer, or different components than those shown in FIGS. 1-4. In the illustrated arrangement, underwater personal mobility device 100 includes the main body 106 that further includes the observation chamber 102. The main body 106 may further include a ballast area 104 and a buoyancy bag 105. In some embodiments, including the illustrated embodiment, the shape of the main body 106 can be configured to allow the user 116 to freely move his arms during operation of the device 100 and may also allow the user 116 to interact with the environment outside of the main body 106 of the device 100. Additionally, the main body 106 may be further comprised of at least one handle 107 which may be grasped by the hands of a user 116 for stability while underwater or to provide guidance and direction for the underwater personal mobility device 100. For example, the user 116 may be able to grab the handles 107 but may also have the full use of his hands for other needs while operating the device 100. For example, in some embodiments, including the illustrated embodiment shown in FIG. 4, user graspable handles 107 can include a controller which may desirably include a throttle and an on/off switch by which the motor can be operated to control propulsion of the device 100. Further, in some embodiments, including the illustrated embodiment, the handles 107 can also include an actuator to be used to control the volume inside the buoyancy bag 105 in order to control the depth of the device 100. In some embodiments, including the illustrated embodiment, the main body 106 may further comprise at least one wheel 103 extending downward from most of the main body 106 of the device 100. The wheel 103, in combination with transport handle 110, desirably allows a user to easily maneuver and transport the device outside of the water. The wheel 103 may also provide transportation advantages in shallow water situations, such as when a user 116 is preparing the device for use in the water, prior to the device obtaining neutral buoyancy at a greater depth.

Figure 5:
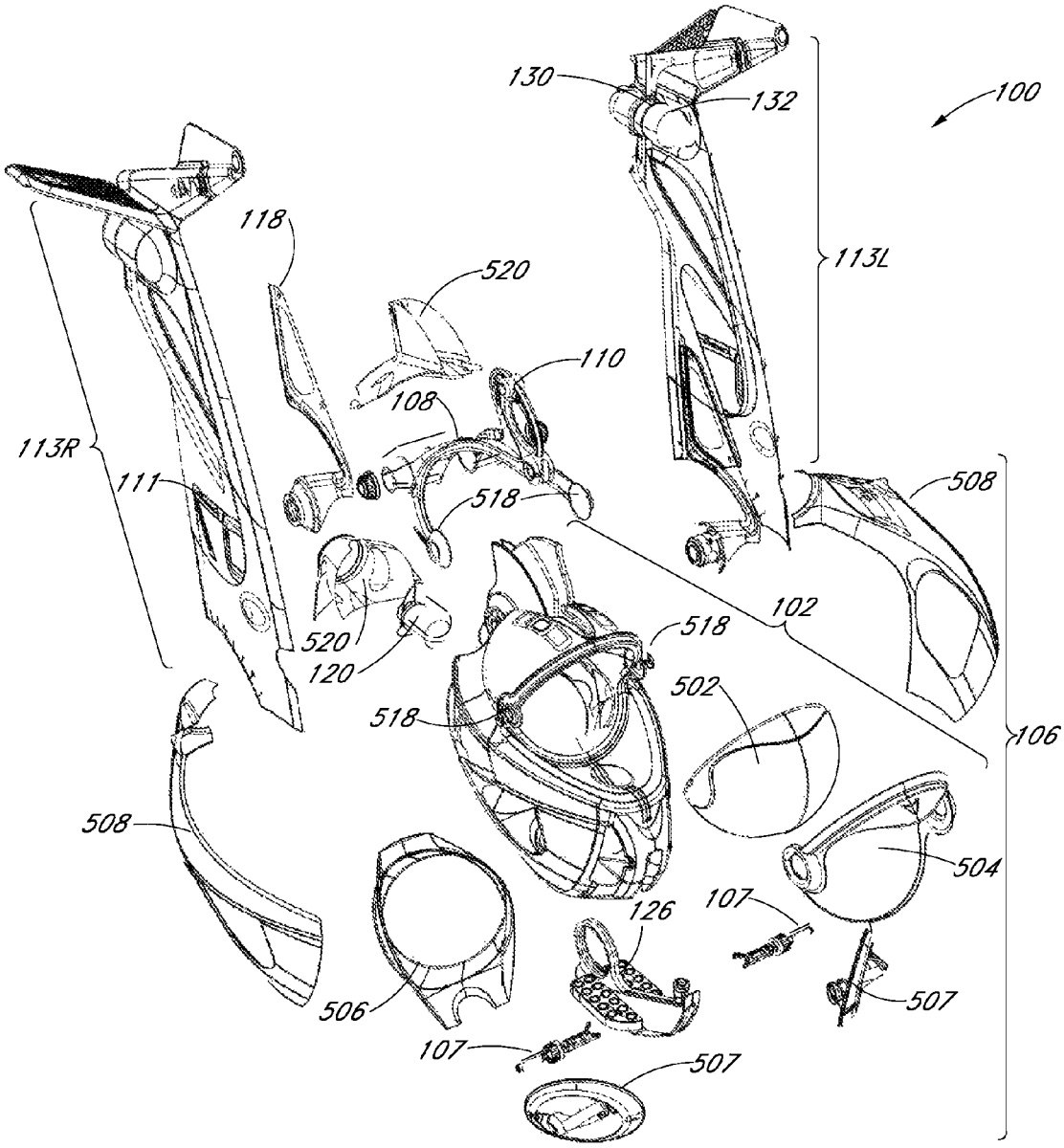
FIG. 5 is a perspective right front view of an exploded assembly of an underwater personal mobility device according to a preferred embodiment of the invention.

As seen most clearly in FIG. 3, the main body 106 may, in some embodiments, including the illustrated embodiment, be supported, directly or indirectly, by the chassis 108. Other embodiments, including the illustrated embodiment, may not include the chassis 108. Chassis 108 may further comprise a transport handle 110 to preferably assist in the carrying and transport of the device 100. As shown in FIGS. 5-7, 9B, and 12, in some embodiments, including the illustrated embodiment, the chassis 108 may comprise a semi-circular member to which the main body 106 may attach preferably by means of mechanical fasteners. The chassis 108 may attach to the main body 106 at any number of attachment points 518. As shown in FIG. 5, two attachment points 518 are illustrated, one on either side of the observation chamber 102. The chassis 108 may include a further attachment point 528 located behind the observation chamber 102, as seen most clearly in FIG. 7. As discussed below with regards to FIG. 8, the attachment point 528 may further serve as a point of attachment for the superstructure 113 such that the superstructure 113 may pivot about an axis A intersecting said attachment point 528, so as to fold back and down for transport of the device 100 or during some periods of operation, such as descending or ascending in the water.

Figure 6:
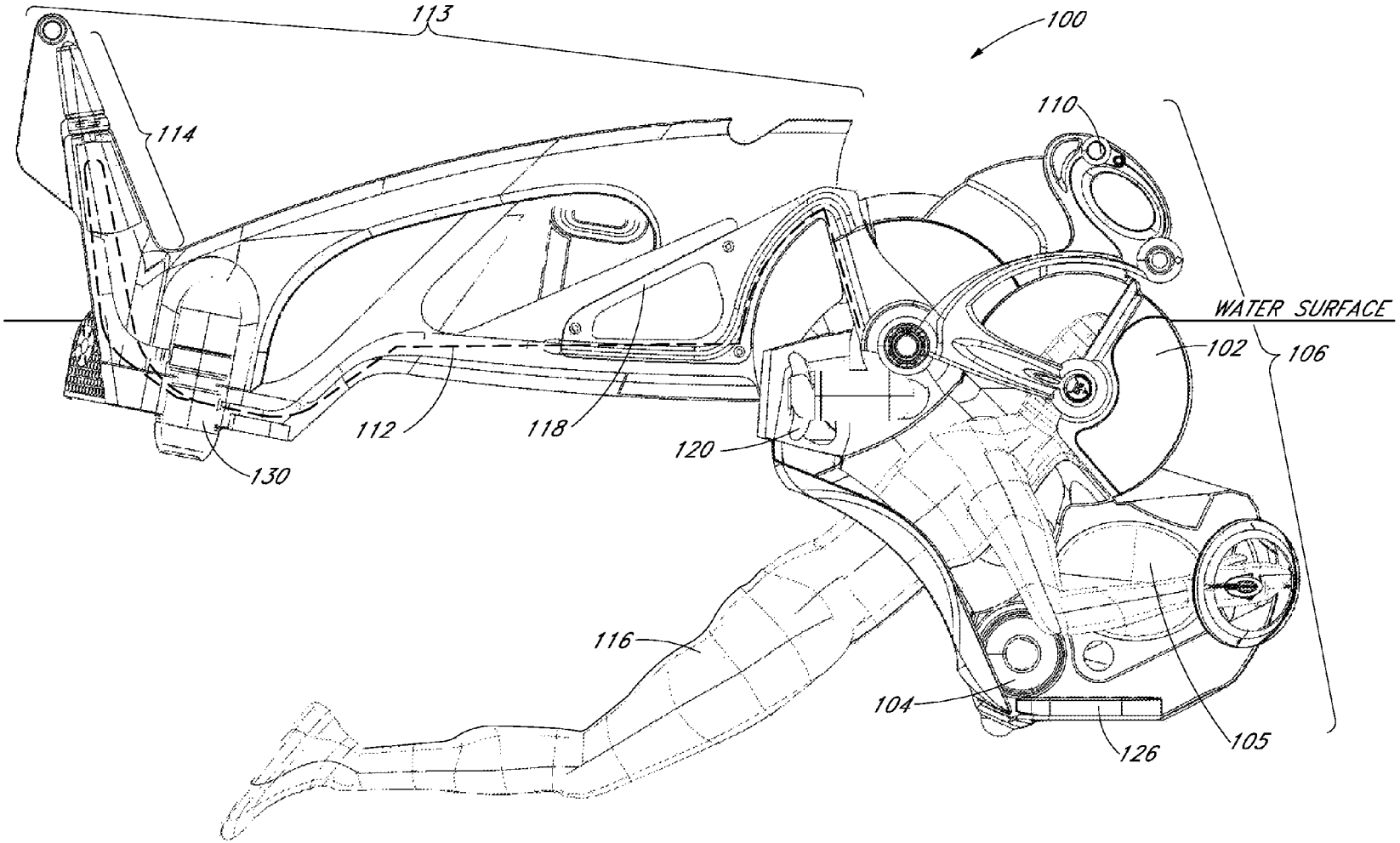
FIG. 6 is a partial right cross-sectional view of a folded orientation of an underwater personal mobility device and a user thereof.
Figure 7:
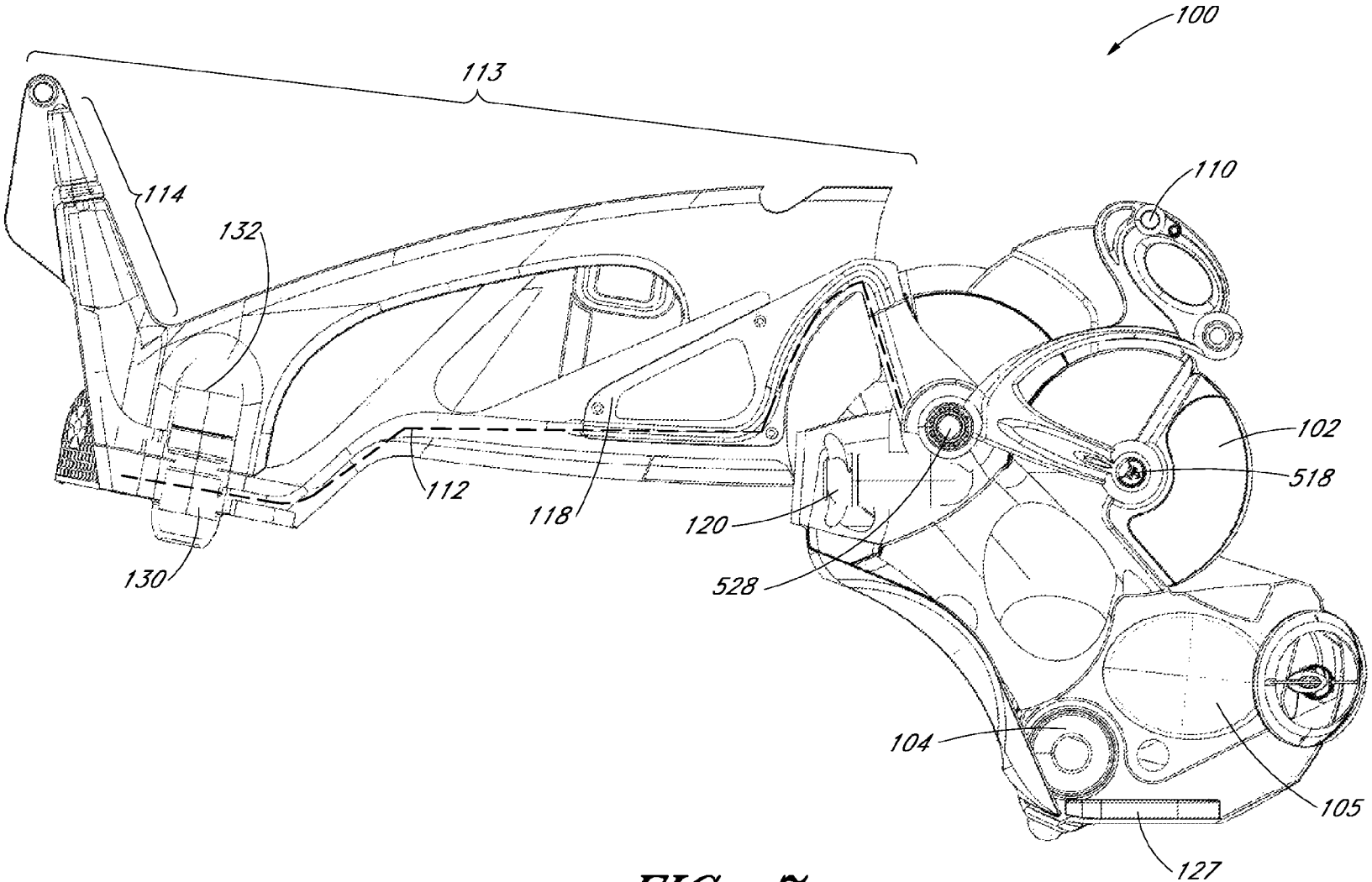
FIG. 7 is a second partial right cross-sectional view of a folded orientation of an underwater personal mobility device shown without a user interacting with the device.
Figure 8:
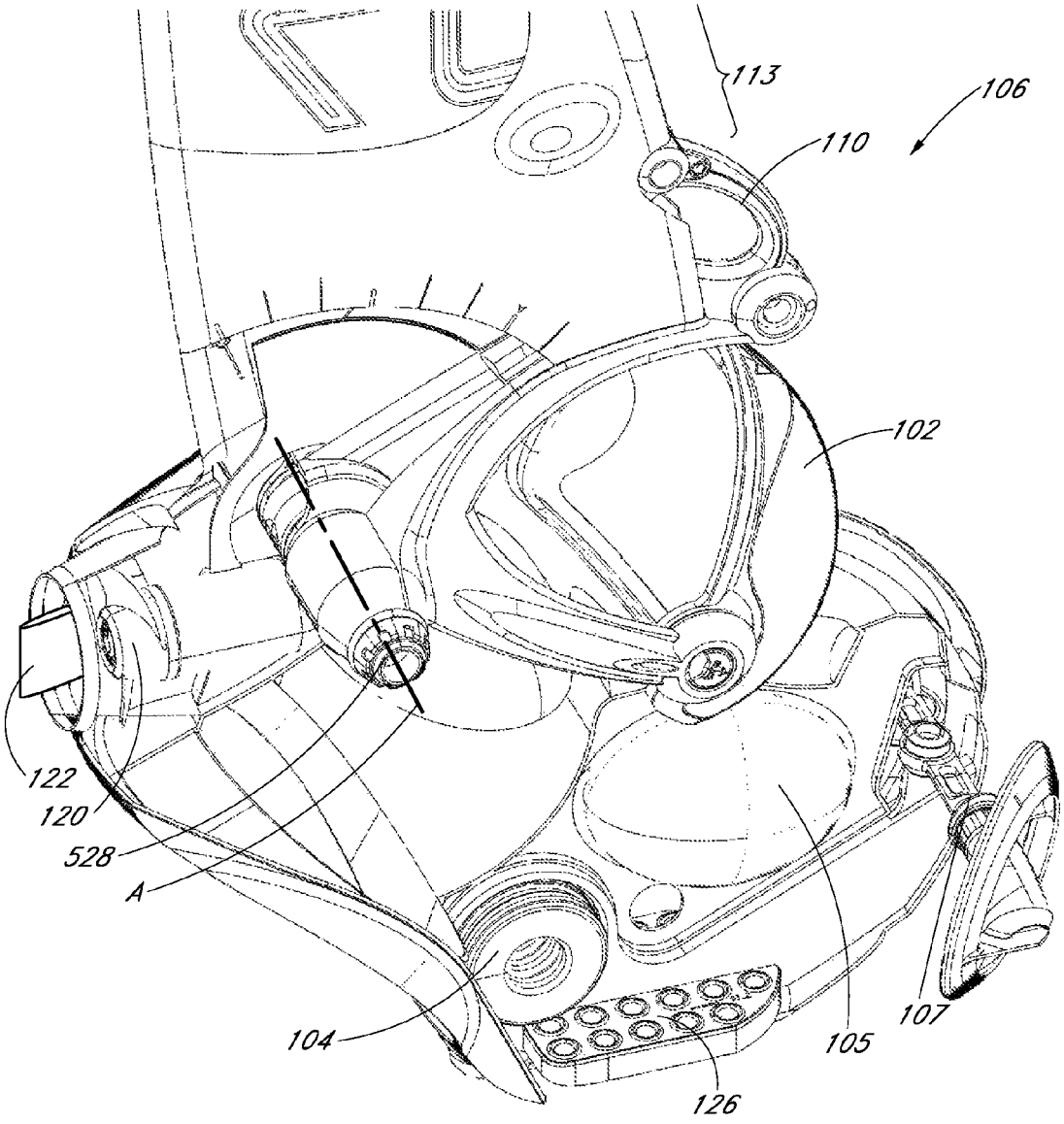
FIG. 8 is a top right perspective view of a main body, observation chamber, and chassis of an underwater personal mobility device shown from the side rear of the device.

FIG. 8 illustrates an enlarged view of the main body 106 of the underwater personal mobility device 100. As discussed above with respect to FIGS. 1-7 and 9B, in some embodiments, including the illustrated embodiment, the chassis 108 can be configured to interconnect with the main body 106 of the device such that the main body 106 is directly or indirectly supported by the chassis 108. In addition, in some embodiments, including the illustrated embodiment, the chassis 108 may be pivotally coupled to a mechanical linkage 118. The rotatable connection of the mechanical linkage 118 with the chassis 108 desirably allows the superstructure 113 to rotate about an axis A that runs through the attachment point 528. The axis A runs perpendicular to the longitudinal axis defined by the height of the superstructure 113. As shown in FIGS. 6 and 7, the superstructure 113 may rotate around axis A at attachment point 528 such that the superstructure 113 folds down and behind the transport handle 110 and observation chamber 102. As discussed above with respect to FIGS. 1-3, the device 100 may further include at least one wheel 103. The wheel 103 allows the device 100 to be more easily transported using the transport handle 110, particularly when the device 100 is in a folded configuration such as that shown in FIGS. 6 and 7. In some embodiments, including the illustrated embodiment, when the superstructure 113 is folded, as is discussed in greater detail below, the transport handle 110 is preferably located in front of the wheel when the transport handle 110 is oriented in the direction of travel while the superstructure 113 is preferably located behind the wheel in order to facilitate better balance of the device 100 when the device 100 is being pulled or transported. In other embodiments, including the illustrated embodiment, the ballast area 104, discussed further below, is preferably located substantially in front of the wheel while the folded superstructure 113 is preferably located behind the wheel in order to balance the device 100 during transport.

FIG. 8 also illustrates the position, in one embodiment, of the ballast area 104 and the buoyancy bag 105. The ballast area 104 may consist of a varied amount of weight, depending on the morphology of the user 116 and the specific purpose of use of the device 100 (e.g., shallow water exploration or deep water exploration). Similarly, the buoyancy bag 105 may be inflated or deflated depending on the morphology of the user and the specific use of the device desired by the user 116 (e.g., accelerating or decelerating the rate of ascent or descent or achieving neutral buoyancy). Additionally, in some embodiments, including the illustrated embodiment, the level of inflation of the buoyancy bag 105 may be controlled by the user 116 via the graspable handles 107. The main body 106 may further include a battery compartment 126, as seen in FIG. 8, as well as in FIGS. 5-7. In some embodiments, including the illustrated embodiment, the battery compartment 126 may provide power for an air pump 130, an electric motor included in propulsion mechanism 120, or any other purpose requiring electricity (e.g., sensors or warning signals) and may also provide additional weight for inclusion in the calculation of neutral buoyancy of the device 100 when submerged underwater.

Figure 9A:
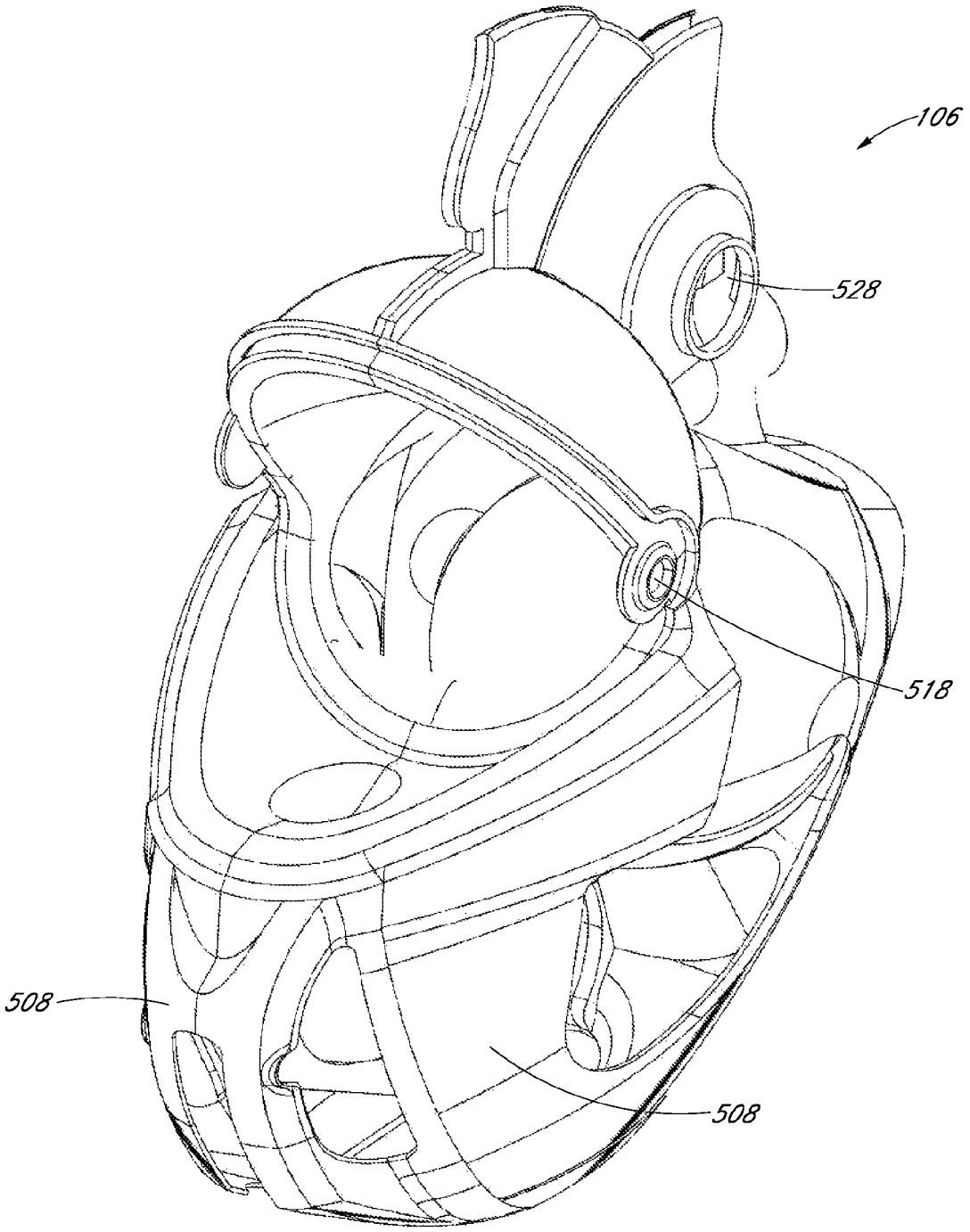
FIG. 9A is a left front perspective view of a main body of an underwater personal mobility device.
Figure 9B:
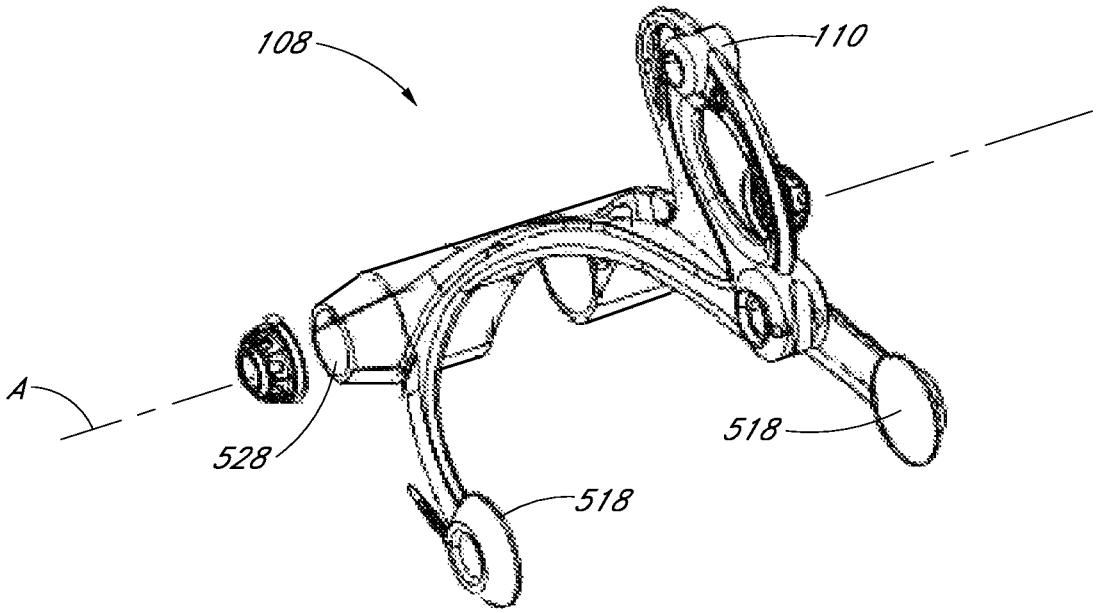
FIG. 9B is a right front perspective view of a chassis of an underwater personal mobility device.

FIG. 9A illustrates another view of the main body 106 of the underwater personal mobility device 100. This view more clearly illustrates, for one embodiment, the locations of the attachment points 518 and 528 and axis A. As discussed above, the attachment points 518 may used to attach the main body 106 to the chassis 108. The attachment point 528 may also be an attachment point between the main body 106 and the chassis 108, but also may provide a point of attachment, and an axis of rotation A, for the mechanical linkage 118 and superstructure 113 such that the superstructure 113 pivots with respect to the main body 106.

The submersible device 100 desirably stays in constant connection with the surface and therefore is able to supply the desirably open observation chamber 102 with air, and therefore, in some embodiments, including the illustrated embodiment, eliminates the need to carry a tank of air for breathing purposes. Advantageously, the head and shoulders of the user 116 preferably remain dry because they fit within the observation chamber 102. Furthermore, the observation chamber 102 desirably provides the additional advantage of allowing the user 116 greater freedom of movement to view the surrounding environment by turning his or her head from side to side within the observation chamber 102. Additionally, the observation chamber 102 desirably provides a comfortable chamber from which to view the underwater environment without the discomfort of needing to hold a breathing device in the mouth.

FIG. 5 depicts an exploded assembly view of a preferred embodiment of the present invention. Underwater personal mobility device 100 includes the main body 106 that, in the illustrated arrangement, is further comprised of observation chamber 102. As shown, a rear portion of the observation chamber 102 may be integrated into and formed together with the main body 106. However, a viewing portion 502 of the observation chamber 102 may be formed from a clear or "see through" material allowing the user to view the surrounding environment while underwater. This viewing portion 502 may, in some embodiments, including the illustrated embodiment, be shaped substantially as a half hemisphere allowing the user 116 a greater range of vision and may be attached, as in the present embodiment, with a curved viewing attachment piece 504. A viewing attachment piece 504 preferably wraps around the circumference of the viewing portion 502 in order to seal the edges where the viewing portion 502 meets the observation chamber 102 in order to substantially prevent the intrusion of water. Other known methods of attaching the viewing portion 502 to the observation chamber 102 may be used (e.g., liquid sealants).

The observation chamber 102 shown in FIGS. 1-11 may further include at least one oxygen sensor or carbon dioxide sensor. In some embodiments, including the illustrated embodiment, the amount of air contained within the observation chamber 102 may remain the same at all times. Furthermore, in some embodiments, including the illustrated embodiment, the constant flow of air preferably maintains a mix of carbon dioxide and oxygen to ensure a proper, breathable mixture is maintained for the user 116.

In some embodiments, including the illustrated embodiment, the observation chamber 102 can be configured to provide a volume of air of 40 liters. Alternative embodiments may have an observation chamber 102 that is configured to provide a volume of air between 10 liters and 100 liters, desirably between 20 liters and 80 liters, more desirably between 30 liters and 70 liters, and even more desirably between 40 liters and 60 liters. However, depending on the morphology of the user 116, this volume of air may vary and therefore influence the neutral buoyancy of the overall device 100. In some embodiments, including the illustrated embodiment, the user 116 can adjust the volume of air inside the buoyancy bag 105 in order to suit different body types. Further, in other embodiments, including the illustrated embodiment, the volume of air within the observation chamber 102 can desirably be adjusted to keep the entire device 100 stable and neutrally buoyant under water.

The main body 106 may, in some embodiments, including the illustrated embodiment, further comprise a user engagement skirt 506. The user engagement skirt 506 may be located proximate the edge of the opening of the observation chamber 102. The user engagement skirt 506 may provide added comfort to the user by acting as cushioning between the upper body or shoulders of the user and the edge of the observation chamber 102. In addition, the user engagement skirt 506 may also act as a non-rigid barrier or sealing member between the interior of the observation chamber 102 and the exterior environment, preventing the substantial entry of water as the device 100 is in use.

As discussed above with respect to FIGS. 1-4 and as shown more clearly in FIGS. 5 and 8, the main body 106 may further comprise user graspable handles 107. These handles 107 may provide stability for the user while operating the device 100 and, in some embodiments, including the illustrated embodiment, may provide a means for controlling the propulsion mechanism 120 of the device 100 or the direction of travel via a rudder 122, fins, or other means. The handles 107 may further provide a means by which a user 116 may adjust the inflation level of the buoyancy bag 105. As shown most clearly in FIGS. 4 and 5, handle covers 507 may also be included to provide a more streamlined front profile for the device 100 and reduce drag forces due to the user's hand position on the user graspable handles 107. In general, the handles 107 are not movable with respect to the main body 106 but in some embodiments, including the illustrated embodiment, the handles 107 may be able to fold closer to the side of the main body 106 for ease of transport and storage of the device 100.

FIG. 9A depicts the main body 106 with lower side panels 508 attached to the body and further illustrates that, in some embodiments, including the illustrated embodiment, the lower side panels 508 may not be solid but may include various openings to provide comfort and utility for the user 116 to interact with the device 100, such as openings allowing freedom of movement of the elbows and arms of a user 116 and protective coverings for the hands. FIG. 5 also shows that the main body 106 may, in some embodiments, including the illustrated embodiment, further comprise lower side panels 508. The lower side panels 508 are desirably attached to the main body 106 below the observation chamber 102 and may be attached using any suitable means (e.g., mechanical fasteners). In some embodiments, including the illustrated embodiment, the lower side panels 508 provide a non-sealing protective enclosure for the lower portion of the main body 106. As seen in FIGS. 5 and 9A, the lower side panels 508 attach to the main body 106 below the observation chamber 102 such that the arms of a user 116 and other components situated within the main body 106 may be protected. However, in some embodiments, including the illustrated embodiment, as seen in FIGS. 5 and 9A, the lower side panels 508 also allow freedom of movement of the user's arms. In some embodiments, including the illustrated embodiment, such as that shown most clearly in FIG. 1, the lower side panels 508 may further comprise openings through which a user's arms may extend, for example, in order for a user 116 to interact with the user graspable handles 107.

In some embodiments including the illustrated embodiment, the device 100 may be powered by a propulsion mechanism 120. The propulsion mechanism can be electric with preferably a 12v, 24v or 36v electric motor preferably integrated into the main body 106 and located above the back of the user 116. The electric motor may be powered by batteries. The location of the batteries can desirably be part of the weight equation resulting in the balance of the overall unit underwater. Power sources of other types (e.g., gasoline motors) with different power characteristics may also be used. In one embodiment including the illustrated embodiment, a constant flow of air is desirably pumped, preferably using an electric air pump, down to an observation chamber 102 via the conduit 112 disposed within the superstructure 113. In some embodiments, including the illustrated embodiment, the energy needed to operate the electric air pump may be supplied by one or more solar panels (see FIG. 10, discussed below), which can desirably be integrated into an above water portion of superstructure 113. Thus, in some embodiments, including the illustrated embodiment, the submersible device 100 can recharge the energy stored within the batteries via solar power.

Additionally, in some embodiments, including the illustrated embodiment, a propulsion mechanism 120 may be integrated into the main body 106. FIGS. 2 and 3 depict a preferred embodiment in which the propulsion mechanism 120, including an electric motor in a housing connected via a shaft to a propeller, is located within the main body 106 behind the observation chamber 102. The force applied by the motor on the propeller desirably directly propels the overall device 100 in the desired direction. In one embodiment, as illustrated in FIG. 8, the propulsion mechanism 120 may further include a rudder 122 which may be mechanically or electrically connected to the graspable handles 107 so as to be controlled thereby to steer the submersible device. In one embodiment, the propulsion mechanism 120 may be enclosed within the main body 106, as illustrated in FIGS. 2 and 3. In other embodiments, including the illustrated embodiment, the propulsion mechanism 120 may be located below the user 116, flanking the user 116, or incorporated into the superstructure 113.

As illustrated in FIG. 5, the propulsion mechanism 120 (e.g., an electric motor and propeller, as shown in the illustration) may preferably be located substantially towards the rear of the main body, above the body position of the user 116 when the user 116 is interacting with the device 100. FIGS. 2, 3, and 6 more clearly illustrate the preferred propulsion mechanism location within the main body. However, in other embodiments, including the illustrated embodiment, the propulsion mechanism 120 may be attached to the chassis 108, attached to the superstructure 113, or at some other location within the main body 106, such as below or to the sides of the body position of the user 116. The propulsion mechanism 120 may be integrated into the main body 106 as shown in FIGS. 1-4 and 6-8. In these embodiments, including the illustrated embodiment, the main body 106 may further comprise a propulsion mechanism cover or housing 520. This cover or housing 520 surrounds the propulsion mechanism 120 to preferably both protect the user 116 from possible injury from moving parts of the propulsion mechanism 120 and also to provide protection for the propulsion mechanism 120. The cover or housing 520 may, in some embodiments, including the illustrated embodiment, provide a further benefit similar to that of a nozzle and may be rotatable in order to change the direction of movement of the device 100. The cover or housing may be formed into one continuous piece or may be separated into two pieces, as shown in FIG. 5.

In some embodiments, including the illustrated embodiment, the user 116 can also use his feet to help maneuver, steer, and/or propel the underwater personal mobility device 100. The device 100 can be configured to allow power to the motor to be cut if the power level of the device 100 drops to a certain level with a low power or other warning signal also provided to the user 116. Whether or not the motor is powered, the user 116 inside the observation chamber 102 desirably can still propel and/or maneuver the device 100 with his or her feet, especially if he or she is wearing flippers. However, in other embodiments, including the illustrated embodiment, other steering components such as flaps or other control surfaces on the superstructure 113 may be used to steer the device 100.

Underwater personal mobility device 100 preferably further includes superstructure 113. The superstructure 113 may provide a variety of benefits, including stability of the device while underwater, directional capability through control surfaces incorporated into the superstructure 113, alerting other marine traffic as to the immediate presence of a diver, and serving as a connection between a user 116 of the device 100 and the ambient environment above the surface of the water. In some embodiments, including the illustrated embodiment, the superstructure 113 preferably comprises a snorkel 114 fluidly connected to an air conduit 112. As shown in FIG. 1, the superstructure 113 may have an area 111 in which a logo or ID number may be placed. As seen most clearly in FIGS. 2, 3, and 5 the superstructure 113 may be secured to the main body 106 via a mechanical linkage 118 that is preferably secured to chassis 108 such that the superstructure is allowed to rotate, as will be discussed below. A superstructure 113 can preferably rotate down and backwards around an axis A as shown in FIG. 8 and discussed above. In one embodiment, the superstructure 113 comprises conduit 112 which preferably connects the observation chamber 102 with the surface via snorkel 114 in order to conduct breathable air to the user 116. Preferably, an upper portion of superstructure 113 extends above the surface of the water, as shown in FIG. 2. In a preferred embodiment, the snorkel 114 is disposed within the upper portion of superstructure 113. The snorkel 114 may extend above the surface of the water. The shape and the length of this snorkel 114 that extends out of the water during use can vary to suit different sea conditions and in some embodiments, including the illustrated embodiment, can be manually or automatically adjustable in response to such conditions. In a preferred embodiment such as that shown most clearly in FIG. 3, the air conduit 112 can extend through the superstructure 113 and through at least a portion of the main body 106 to transfer air from the snorkel to the observation chamber 102. This flow of air can be driven by an air pump 130, which in some embodiments, including the illustrated embodiment, may be located in the superstructure 113. The snorkel 114, in connection with air conduit 112, preferably serve as a mechanism by which ambient air from the surface is provided to the observation chamber 102 below in order for the user 116 to breathe. However, in other embodiments, including the illustrated embodiment, the snorkel 114, in connection with air conduit 112, can serve as a mechanism by which ambient air from the surface can be provided to a mouthpiece or other breathing device in order for the user 116 to breathe. In some embodiments, including the illustrated embodiment, a one-way valve can be provided to eliminate water from the snorkel 114.

In a preferred embodiment such as that shown in FIGS. 1-11, the superstructure 113 may be connected to the chassis 108 via the mechanical linkage 118. In some embodiments, including the illustrated embodiment, such as that shown in FIG. 3, the mechanical linkage 118 may have a shape similar to that of a "mohawk" such that a substantially triangular section extends, in some orientations, substantially vertically above the main body 106. The mechanical linkage 118 provides a structure upon which the superstructure 113 may be mounted using any known type of mechanical fasteners. In some embodiments, including the illustrated embodiment, the mechanical linkage 118 linkage can interconnect all of the upper components of the device 100, such as the superstructure 113, the propulsion mechanism 120, etc. to the chassis 108 and the main body 106 of the device 100.

As shown in FIG. 5, the superstructure 113 may be formed from two pieces or it may comprise more or fewer pieces. The mechanical linkage 118 is pivotably coupled to the main body 106, in some embodiments, including the illustrated embodiment, such that the superstructure 113 may obtain a folded configuration such as that shown in FIGS. 6 and 7.

A preferred embodiment of the invention in a folded configuration is shown in FIGS. 6 and 7. As will be discussed with respect to FIG. 8, the superstructure 113 may fold down and back towards the body of the user 116. By folding into such a configuration, the device 100 obtains a more compact profile to facilitate easier transport and storage. Furthermore, the device 100 in a folded configuration may also provided added benefits to the user 116 when descending and ascending in the water, as the lower profile of the device 100 when in a folded configuration such as that shown in FIGS. 6 and 7 may allow for easier control and stability of the device and enable the user 116 to more easily maintain the device 100 in an upright orientation in shallow water situations. As noted above, the mechanical linkage 118 can be rotatably or pivotally coupled to the chassis 108. Accordingly, and in some embodiments, including the illustrated embodiment, the superstructure 113 can rotate relative to the main body 106 of the device 100 about the linkage axis A shown most clearly in FIG. 8. In some embodiments, including the illustrated embodiment, the rotation can be in a range of between at least about 45 degrees and about 90 degrees. The rotation can also be in a range of between at least about 65 degrees and about 80 degrees. In some embodiments, including the illustrated embodiment, the rotation can be about 74.5 degrees back. The device 100 can be folded when the device 100 is on the surface, or at other times during operation such as when the device 100 is in shallow water. A limit and/or a locking bolt can be located at either extremity of the axial range of motion to stop the superstructure 113 from further rotation in one direction and/or to lock the superstructure 113 in place against rotation in either direction.

The superstructure 113 and the mechanical linkage 118 may also be configured, in some embodiments, including the illustrated embodiment, to provide the conduit 112 for air to pass between the observation chamber 102 and ambient air at the surface via the snorkel 114. In one embodiment such as that shown in FIGS. 6 and 7, the conduit 112 may extend along the mechanical linkage 118 to fluidly interconnect the airflow mechanism of the observation chamber 102 with the ambient air at the surface via the snorkel 114. In some embodiments, including the illustrated embodiment, the conduit 112 may be flexible to allow the superstructure 113 to rotate into a folded position such as that shown in FIGS. 6 and 7 while remaining attached to the observation chamber 102 in order to provide a continuous supply of breathable air to the user 116. In some embodiments, including the illustrated embodiment, the conduit 112 may be located along a rear edge of the superstructure 113. In other embodiments, including the illustrated embodiment, the conduit 112 may be located at other positions within the superstructure 113, such as the forward edge. The snorkel 114 may be flexible in order to adapt, via user 116 manipulation, to changing surface conditions. The snorkel 114 may, in some embodiments, including the illustrated embodiment, extend or shorten in length in response to commands from a user 116. The snorkel 114 may be adjustable prior to use of the device 100 or may be adjustable during use.

In some embodiments, including the illustrated embodiment, an air pump 130 may be provided along a portion of the superstructure 113. In some embodiments, including the illustrated embodiment, such as that shown in FIG. 7, the air pump 130 may be fluidly connected to the air conduit 112 and the snorkel 114 in order to pump air from the ambient environment through the air conduit 112 to the observation chamber 102. In other embodiments, including the illustrated embodiment, the air pump 130 may be fluidly connected to a breathing mask or other apparatus used to provide air to a user. As seen in FIGS. 2-7 and FIG. 10, an air pump 130 may, in some embodiments, including the illustrated embodiment, be provided at a top end of the superstructure 113. The air pump 130 may preferably be immersed in the water when the device 100 is in use, or it may be above the surface the water.

Figure 10:
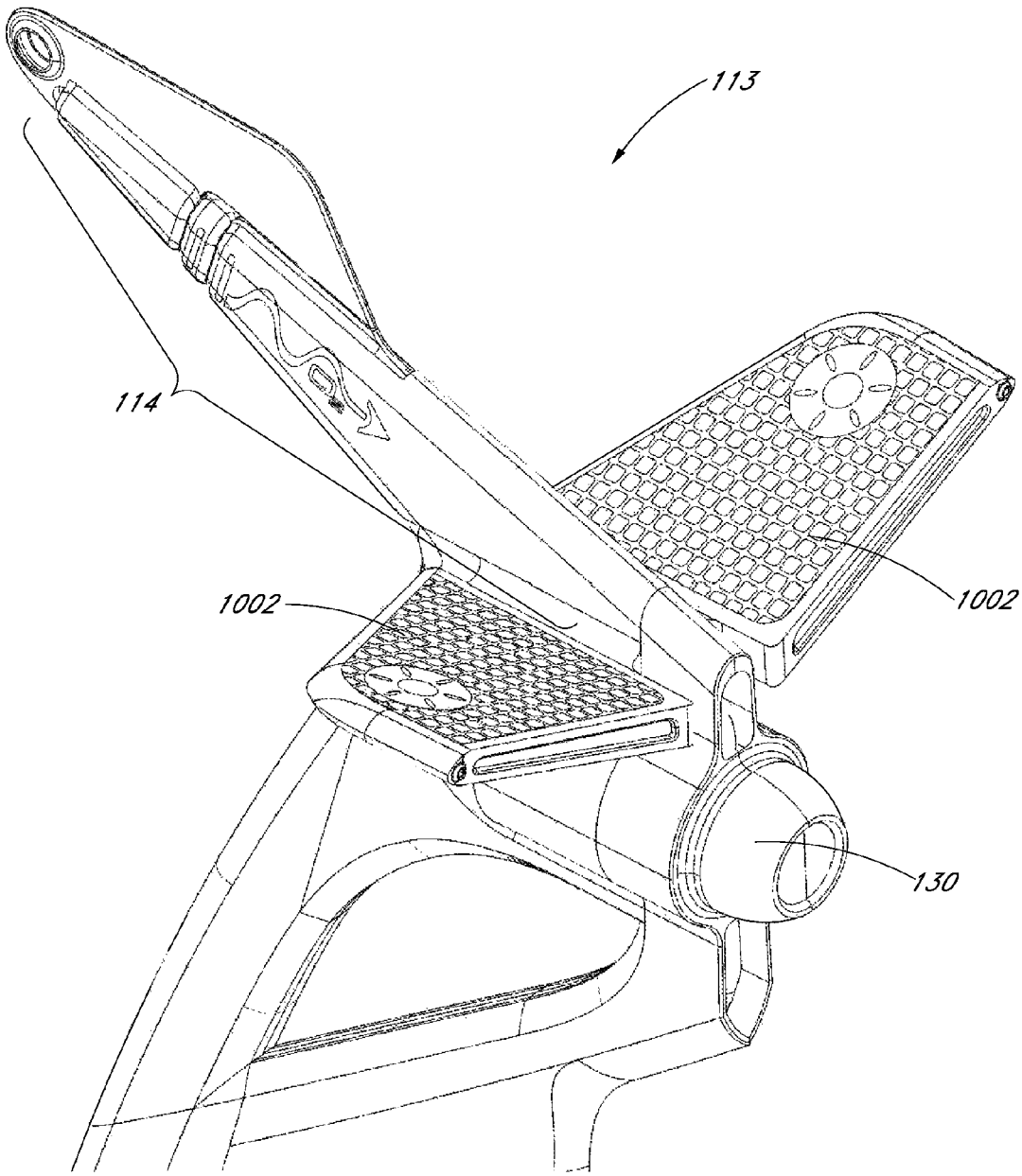
FIG. 10 is a left rear perspective view of an above-water portion of a superstructure of an underwater personal mobility device.

FIG. 10 further illustrates that, in some embodiments, including the illustrated embodiment, the superstructure 113 may further comprise additional stability surfaces 1002. These surfaces 1002 may allow the superstructure 113 to achieve greater stability when the device 100 is in an unfolded configuration such as that shown in FIGS. 1-4 by acting as stabilizing surfaces such as those on an aircraft. Furthermore, the stability surfaces may, in an alternative embodiment, further comprise solar panels connected to batteries, such as those contained in battery compartment 126, to provide renewable energy for the device 100. The stability surfaces 1002 may be secured to the superstructure 113 such that they are movable depending on water conditions or as desired by the user, or they may fold such that they lie closer to the superstructure 113 to facilitate easier storage of the device 100. The surfaces 1002 may, in other embodiments, including the illustrated embodiment, be in a fixed position with respect to the superstructure 113. The superstructure 113 may further comprise a buoy 132, most clearly seen in FIGS. 5 and 7. The buoy 132 is preferably near the surface of the water and provides a buoyant force for the device 100, as will be further discussed below with respect to FIG. 11. The superstructure 113 may further comprise a safety beacon or other safety feature to enable other traffic passing on the surface of the water to locate, avoid, or approach a user 116 of the device 100.

FIGS. 1, 2, and 6 further depict one possible body position of a user 116 employing the device 100. In some embodiments, including the illustrated embodiment, the user's body position is desirably neither vertical nor hunched over from a sitting position. The user 116 is preferably in a natural swimming position, with the stomach facing substantially downward and the body at a slightly upward angle. This body positioning mimics that of the natural body position of a swimmer or scuba diver. The preferred body positioning as shown in the illustrated embodiment gives the user 116 a clear view ahead of him, as well as to either side. Furthermore, in the preferred embodiment as illustrated, the device 100 does not block a user's downward angled view. When the device 100 is deployed in the water, as shown in FIGS. 1, 2, and 6, the user 116 can preferably enter the observation chamber 102 from underneath the chamber 102, below the water. In some embodiments, including the illustrated embodiment, once inside the observation chamber 102, the head and shoulders of the user 116 can be out of the water while the rest of the user's body is submerged. In some embodiments, including the illustrated embodiment, the superstructure 113 may be able to fold backwards prior to the user entering the water or as the user exists the water, as shown in FIG. 6, and discussed in greater detail above.

Figure 11:
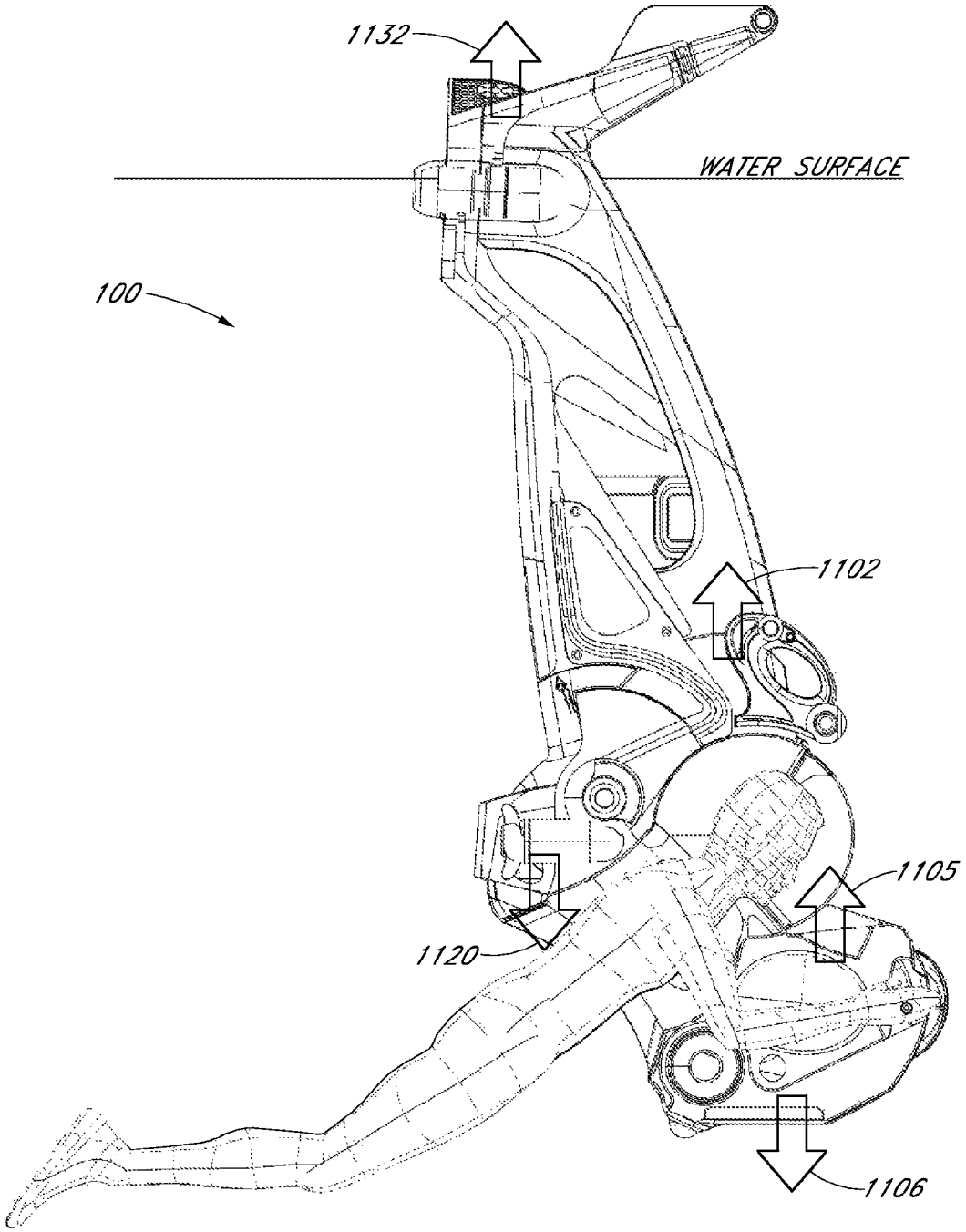
FIG. 11 is a partial right cross-sectional view of a buoyant and ballast mechanism for an underwater personal mobility device.

Desirably, the submersible device 100 remains vertically stable under water. In some embodiments, including the illustrated embodiment, the equalization of two opposite forces preferably keeps the unit neutrally buoyant and upright, as shown in FIG. 11, discussed below. For example, the volume of air in the open observation chamber 102 results in an upward force acting to push the submersible device towards the surface. Additionally, the overall weight of the unit (including components such as the batteries, motor, and air pump) provides a force acting in the opposite direction. In some embodiments, including the illustrated embodiment, this stability can be important with the aim of keeping the volume of the observation chamber 102 open and clear of water, free for ingress or egress of the user.

In the embodiment illustrated in FIG. 11, the arrows represent the volumes of enclosed air which can apply vertical forces (shown with up arrows) pushing the underwater personal mobility device 100 up to the surface, and further represent volumes of high density weight materials which can apply vertical forces (shown with down arrows) pushing the underwater personal mobility device 100 down towards the bottom. The point of neutrality, or neutral buoyancy, can be calculated, for example, by the volumetric equation which takes into consideration the location in space of all of the volumes providing upward and downward forces. In the illustrated embodiment, a buoy 1132 can be provided towards the upper end of superstructure 113 and preferably stay close to the surface of the water. Thus, in some embodiments, including the illustrated embodiment, the buoy 1132 can prevent the unit from going deeper than a desired maximum depth. In some embodiments, including the illustrated embodiment, the volume of the observation chamber 102 may also provide a force acting to push the device 100 towards the surface, as indicated by arrow 1102. Additionally, the volume of the buoyancy bag 105 may provide additional upward force, as indicated by arrow 1105. To counteract these forces which act to cause the device 100 to rise to the surface of the water, the volume of high density weight materials, including the main body 106 and ballast area 104, act in the direction as indicated by arrow 1106; that is, to cause the device 100 to submerge in the water. Furthermore, the volume of the propulsion mechanism 120 may also act to submerge the device 100, as indicated by arrow 1120. As discussed above, in some embodiments, including the illustrated embodiment, a user 116 may vary the rate of ascent or descent of the device 100 by inflating or deflating the buoyancy bag 105 or through other means. Safety equipment such as sensors, signals, or electronic controls may also be incorporated into device 100 in other embodiments, including the illustrated embodiment. This safety equipment may act to limit the rate of ascent or descent to set levels or may limit the maximum depth to which the device 100 may descend.

In some embodiments, including the illustrated embodiment, the submersible device 100 can travel between the surface and a depth of 3 feet, more desirably between the surface and a depth of 5 feet, or most desirably between the surface and a depth of 2 meters or approximately 7 feet. In some embodiments, including the illustrated embodiment, the submersible device 100 can desirably operate at a depth of at least 3 feet, more desirably at a depth of at least 5 feet, or most desirably at a depth of at least 7 feet or 2 meters. In some embodiments, including the illustrated embodiment, the submersible device 100 can desirably operate at a depth of no more than 20 feet, more desirably at a depth of no more than 15 feet, even more desirably at a depth of no more than 10 feet, or most desirably at a depth of no more than 7 feet without submerging the superstructure below the waterline. In some embodiments, including the illustrated embodiment, the submersible device 100 can desirably operate at a depth of no more than 20 feet, more desirably at a depth of no more than 15 feet, even more desirably at a depth of no more than 10 feet, or most desirably at a depth of no more than 7 feet while the submersible device 100 remains neutrally buoyant. In some embodiments, including the illustrated embodiment, the submersible device 100 can reach speeds of between 2 and 10 knots, more desirably between 3 and 8 knots, and most preferably between 4 and 6 knots. In some embodiments, including the illustrated embodiment, the submersible device 100 can desirably reach a speed of at least 2 knots, more desirably a speed of at least 4 knots, more desirably a speed of at least 6 knots, even more desirably a speed of at least 8 knots, and most desirably a speed of at least 10 knots.

In an alternative embodiment, scanner and acquisition sensors can be provided on the device 100. For example, in some embodiments, including the illustrated embodiment, the device 100 can be equipped with at least one scanner and/or at least one sensor. The scanner and acquisition sensor 119 may be located on the superstructure 113, as shown in FIG. 2. During use, therefore, in addition to allowing a user 116 to discover a reef or other underwater feature, in some embodiments, including the illustrated embodiment, the device 100 can also gather data about the ocean and ocean life, including for example, water quality, the temperature of the currents, the density of plankton and bacteria, the acidity of the water, or the status of photosynthesis in the coral reef. Without any effort or particular focus, the user 116 can gather information which can then be stored or directly transferred to a common server via the internet and become accessible by researchers around the world. The scanner can define and record a 3D map of the underwater feature and its movement in deep and shallow water. In accordance with some embodiments, including the illustrated embodiment, scanned and acquired information can be transferred either automatically or manually to provide an updated 3D map of the bottom of the sea, as well as conditions of the ocean and ocean life. Other various sensors can be incorporated into the unit as desired. It is contemplated that an open source for oceanic data may become crucial and in demand by marine biologists around the world.

Although this application discloses certain preferred embodiments and examples, it will be understood by those skilled in the art that the present inventions extend beyond the specifically disclosed embodiments to other alternative embodiments and/or uses of the invention and obvious modifications and equivalents thereof. Further, the various features of these inventions can be used alone or in combination with other features of these inventions other than as expressly described above. While the disclosed embodiments are primarily directed to an underwater personal mobility device, aspects of the invention may be used in connection with other types of submersible devices. Thus, it is intended that the scope of the present inventions herein disclosed should not be limited by the particular disclosed embodiments described above, but should be determined only by a fair reading of the claims that follow.

What is claimed is:

1. An underwater personal mobility device comprising:

a superstructure comprising a snorkel;

an observation chamber;

a propulsion mechanism;

at least one buoyancy chamber;

at least one weight compartment; and a main body;

wherein the superstructure is rotatable with respect to the main body such that the device may fold for ease of use.

2. The underwater personal mobility device of claim 1 further comprising a chassis, wherein the superstructure is connected to the main body via the chassis.

3. The underwater personal mobility device of claim 1 further comprising an air pump.

4. The underwater personal mobility device of claim 3, wherein the observation chamber is at least indirectly supported by the chassis.

5. The underwater personal mobility device of claim 3, wherein the observation chamber is directly supported by the chassis.

6. The underwater personal mobility device of claim 4 further comprising a user engagement skirt proximate the edge of the opening of the observation chamber.

7. The underwater personal mobility device of claim 4, wherein the observation chamber is fluidly connected to the snorkel.

8. The underwater personal mobility device of claim 7 further comprising at least one valve located above the surface and fluidly connected to the snorkel.

9. The underwater personal mobility device of claim 8, wherein the air pump is operatively connected to the observation chamber and the surface via the snorkel.

10. The underwater personal mobility device of claim 4, wherein the observation chamber further comprises at least one oxygen sensor.

11. The underwater personal mobility device of claim 3 further comprising a mouthpiece fluidly connected to the snorkel wherein the air pump assists in the transfer of air from the surface to the mouthpiece.

12. The underwater personal mobility device of claim 1, wherein the propulsion mechanism further comprises an electrically powered motor, a propeller driven by said motor, and at least one battery connected to said motor.

13. The underwater personal mobility device of claim 1 further comprising a superstructure buoy.

14. The underwater personal mobility device of claim 13, wherein the buoyancy chamber, superstructure buoy, propulsion mechanism, and weight compartment are placed such that the underwater device may achieve neutral buoyancy and vertical stability at a desired depth.

15. The underwater personal mobility device of claim 1, wherein the propulsion mechanism may be operatively connected to one of the main body, the superstructure, or the chassis.

16. The underwater personal mobility device of claim 1, wherein the superstructure is rotatably connected to the chassis via a mechanical linkage.

17. The underwater personal mobility device of claim 16, wherein the superstructure rotates about a linkage axis that is perpendicular to the axis defined by the mechanical linkage.

18. The underwater personal mobility device of claim 17, wherein the superstructure further comprises a fin extending at least partway between the main body and an opening of the snorkel.

19. The underwater personal mobility device of claim 1, wherein the superstructure further comprises solar power generation panels.

20. The underwater personal mobility device of claim 18 further comprising a handle integrated into the chassis and a wheel located substantially below the main body of the device such that force exerted on the handle results in rolling the underwater personal mobility device.

21. The underwater personal mobility device of claim 20 wherein the handle is located substantially in front of the wheel and the superstructure is rotated such that the superstructure is located substantially behind the wheel.

22. A method of underwater exploration, the method comprising:

providing an underwater personal mobility device comprising an observation chamber and a superstructure further comprising a snorkel fluidly connected to the observation chamber wherein the superstructure is foldable to a substantially horizontal orientation;

submerging said underwater personal mobility device;

unfolding said superstructure of said device to achieve a substantially vertical orientation; and breathing by a user of air which is supplied through said snorkel.

23. The method of underwater exploration of claim 22 further comprising the step of inserting at least the head of a user into the observation chamber.

* * * * *